US005277229A

United States Patent [19]

Kikuchi et al.

[11] Patent Number: 5,277,229

[45] Date of Patent: Jan. 11, 1994

[54] WEFT SUPPLY AND TRANSPORT SYSTEM FOR A LOOM

[75] Inventors: Shuichi Kikuchi, Shiga; Yoshiaki Yamaguchi, Ohtsu, both of Japan

[73] Assignee: Murata Kikai Kabushiki Kaisha, Kyoto, Japan

[21] Appl. No.: 930,000

[22] Filed: Aug. 13, 1992

[30] Foreign Application Priority Data

Aug. 21, 1991 [JP] Japan ..... 3-235498

[51] Int. Cl.[5] ..... D03D 47/34

[52] U.S. Cl. ..... 139/1 R; 242/35.5 A; 414/331; 414/222; 139/450

[58] Field of Search ..... 242/35.5 A; 139/1 R, 139/450, 435.1; 414/331, 222, 908; 198/803.12

[56] References Cited

U.S. PATENT DOCUMENTS 4,846,618 7/1989 Matsui ..... 242/35.5 A
5,131,437 7/1992 Shaw et al. ..... 139/450

FOREIGN PATENT DOCUMENTS 0144652 6/1985 European Pat. Off. ..... 139/1 R
1-317965 12/1989 Japan ..... 139/1 R

*Primary Examiner*—Andrew M. Falik
*Attorney, Agent, or Firm*—Spensley Horn Jubas & Lubitz

[57] ABSTRACT

A weft supply system of a loom using an overhead traveling truck between a package supply station and a weft supply station near the loom for holding and carrying a package wherein a package delivery device is connected to the package supply station for delivering specific types of packages to the package supply station.

7 Claims, 5 Drawing Sheets

WEFT SUPPLY AND TRANSPORT SYSTEM FOR A LOOM

BACKGROUND OF THE INVENTION

1. Field of the Invention

The present invention relates to a weft supply system of a loom whereby a weft is supplied in a form of a conical package.

2. Prior Art

In a modern textile factory many types of looms are employed. A weft to be used in these looms is supplied in the form of a conical package wound with a large amount of yarn; the package is installed and used on the loom. It is, therefore, desirable to use a weft supply system for automatically supplying of weft to a loom and for promoting good housekeeping around the loom.

As a prior-art weft supply system there has been known such a system that has been disclosed in Japanese Patent Laid-Open No. Hei 1-317965, which operates an overhead traveling truck disposed for holding and carrying a package between the package supply station connected to a warehouse or other where packages are stored and a weft supply station located near the loom.

The prior-art weft supply system is suitable for supplying a single kind, or type, of weft to a number of looms, and therefore has a problem that it is difficult for the system to supply various kinds of packages to a number of looms.

OBJECT AND SUMMARY OF THE INVENTION

The present invention has been accomplished in an attempt to solve the above-described problems inherent to prior-art techniques and has as its object the provision of a weft supply system which is capable of supplying different kinds of packages to many looms.

To achieve the above-mentioned object, the weft supply system of the present invention uses an overhead traveling truck which is located between a package supply station and a weft supply station near the loom and conveys a package, and a selective package take-out device connected to the package supply station for providing a package of a selected type. Subsequent references herein to the package take-out device are intended to designate the above-described device which can select a package of a desired type from packages of several different types.

The package take-out device connected to the package supply station is designed to take-out a package of a specific type of weft and supply the taken-out package to the package supply station, from which a desired specific type of package will be conveyed to a specific loom by the overhead traveling truck.

DETAILED DESCRIPTION OF PREFERRED EMBODIMENT

Figure 1:
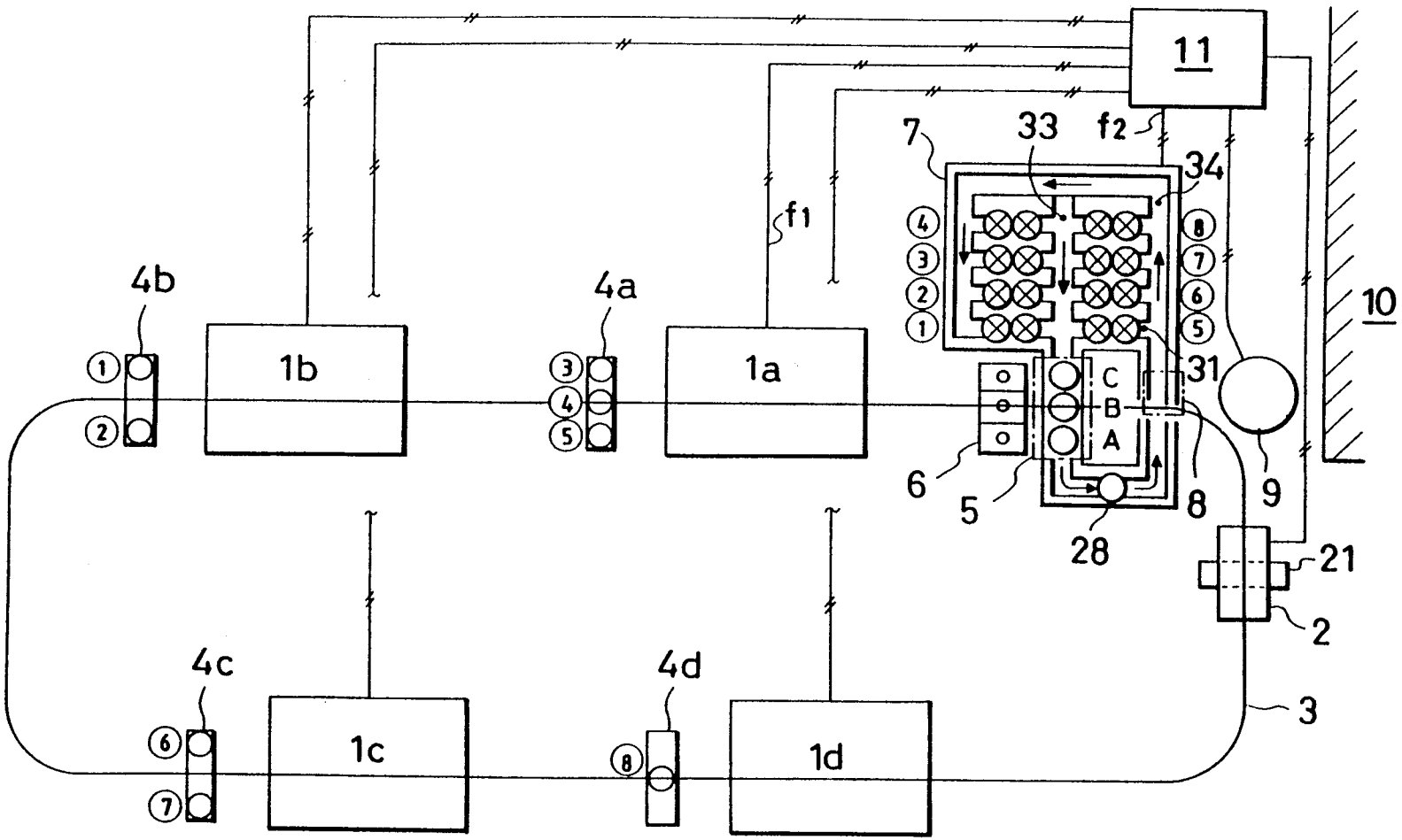
FIG. 1 is a general layout drawing of a weft supply system of the present invention.

Hereinafter a preferred embodiment of a weft supply system of a loom according to the present invention will be explained with reference to the accompanying drawings. FIG. 1 is a general layout drawing of the weft supply system of the present invention.

In FIG. 1, numerals 1*a* to 1*d* denote looms. A number of looms (only four sets are illustrated for simplification) are set below the circulating rail 3 of the overhead traveling truck 2. Beside the loom 1 are located weft supply stations 4*a* to 4*d*. Furthermore, a package supply station 5 and an empty take-up tube recovery station 6 are installed in series below the rail 3. To this package supply station 5 is connected the package take-out device 7. A numeral 8 refers to a transfer station; a numeral 9, a transfer robot; a numeral 10, a warehouse; and a numeral 11, a control device.

Figure 2:
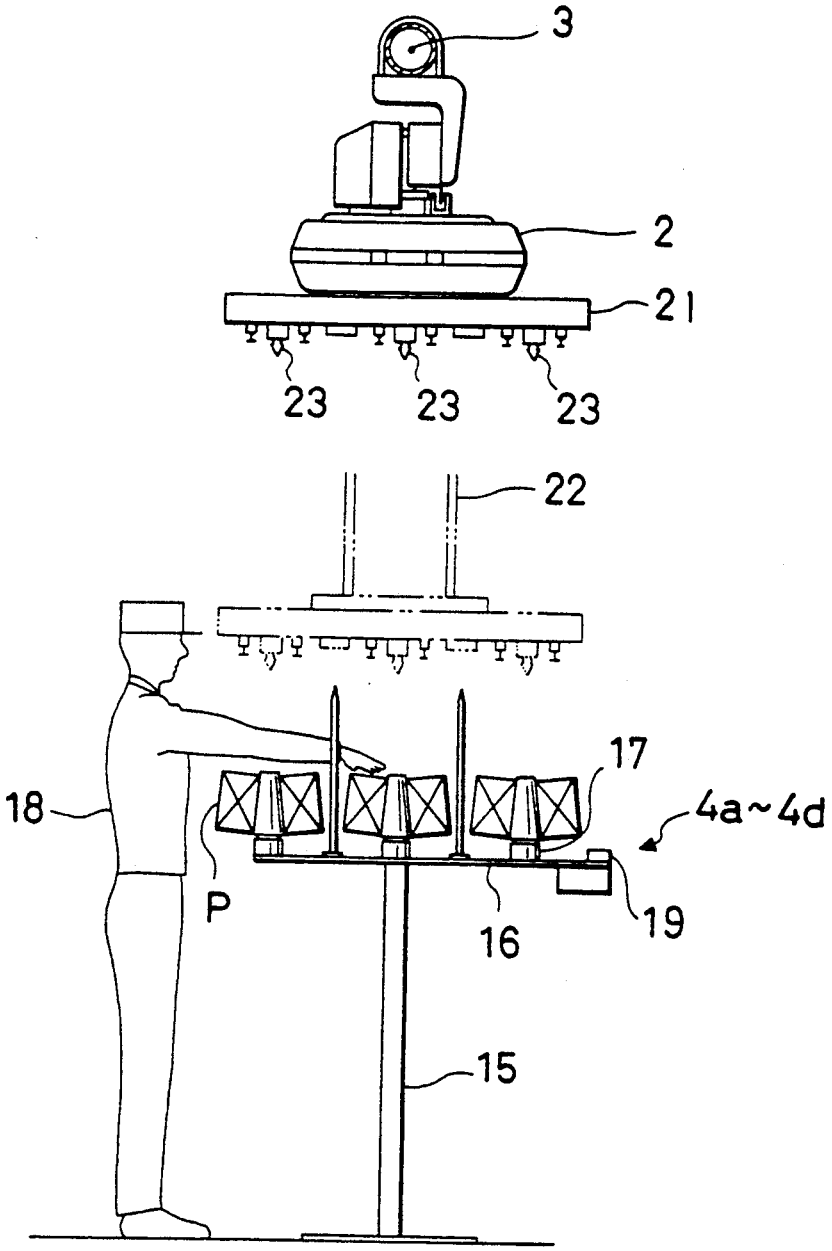
FIG. 2 is a side view of the weft supply station.

Next, each part will be explained in detail. In FIG. 2, the weft supply stations 4*a* to 4*d* are of such a constitution that a plate 16 is installed on stand 15, and one to three (three in the illustration) peg shafts are projectingly installed on the plate 16; on the peg shafts 17 are inserted packages or empty take-up tubes. In the illustration, an operator 18 replaces a package P with an empty take-up tube, carries the package P to a specific position on the loom which is not illustrated, and splices the yarn ends. In this case, however, there may be used an automatic weft supply station capable of automatically replacing the package with the take-up tube and automatically splicing the yarn ends. A numeral 19 denotes a switch box. The operator 18 depresses the switch, after inserting an empty take-up tube on the peg shaft 17, to operate the overhead traveling truck to carry the empty take-up tube.

Figure 3:
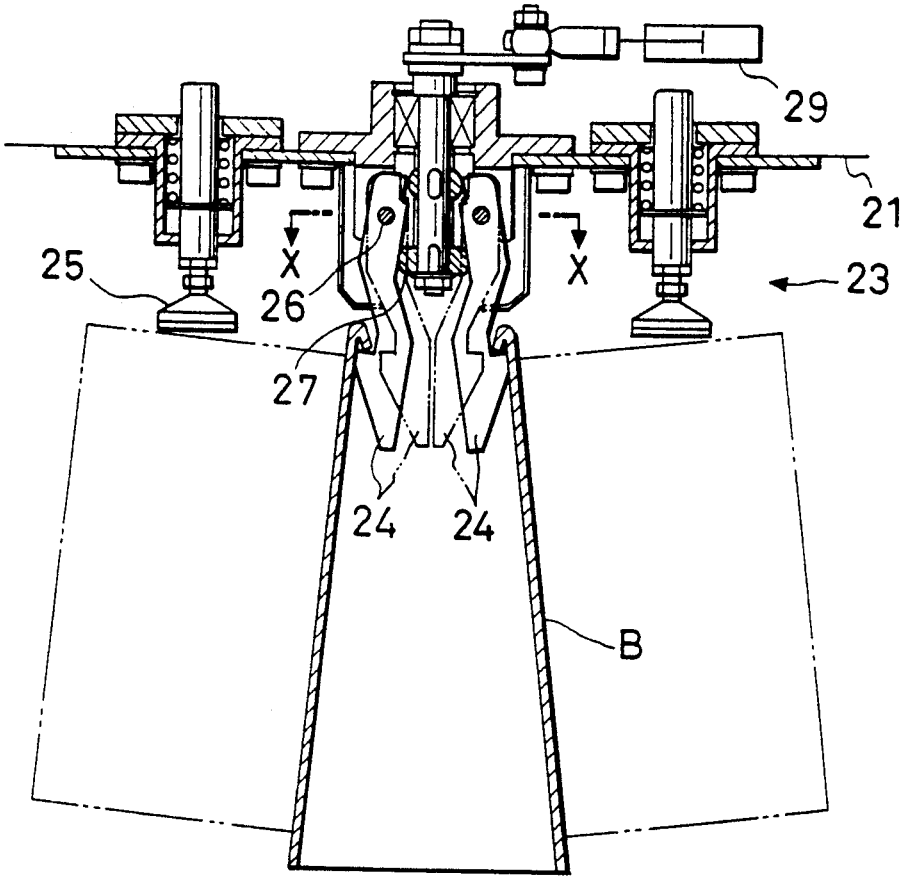
FIG. 3 is a sectional view of a chuck of an overhead traveling truck.
Figure 4:
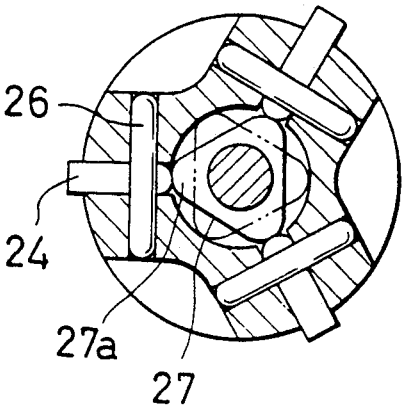
FIG. 4 is a sectional view taken along line X—X of FIG. 3.

From the overhead traveling truck is suspended a carrier 21, which can be moved up and down by use of a hoist belt 22. The carrier 21 is provided with three chucks 23 facing down. As shown in FIGS. 3 and 4, the chuck 23 has three openable jaws 24 and three spring-loaded pads 25 which are equally spaced 120 degrees apart. The jaws 24 are rotatably supported on the shaft 26 such that their side faces will contact the triangular cam 27. In FIG. 4, when the triangular cam 27 is in a position indicated by a full line, the lobe 27*a* pushes the side face of the jaws 24 to open the jaws 24. In this state the hooked end of the small-diameter part of the part-up tube B is caught by the jaws 24 (as shown by a solid line in FIG. 3). Reversely, when the triangular cam 27 is in a position indicated by an alternate long and two short dashes line, the jaws 24 are freed on the side face, thus closing until their opening is smaller than the inner diameter of the small-diameter part of the take-up tube B (as shown by two dots and dash line in FIG. 3). This triangular cam 27 makes reciprocative rotation within an angle of 60 degrees by a cylinder 29 in the carrier 21. With the jaws 24 in a closed state, when the carrier 21 goes downward, the pad 25 contacts the side face of the package P, thus positioning the package P. The jaws 24, when opened, hook the package P, and therefore the package P will never tilt since the pad 25 is provided.

Figure 5:
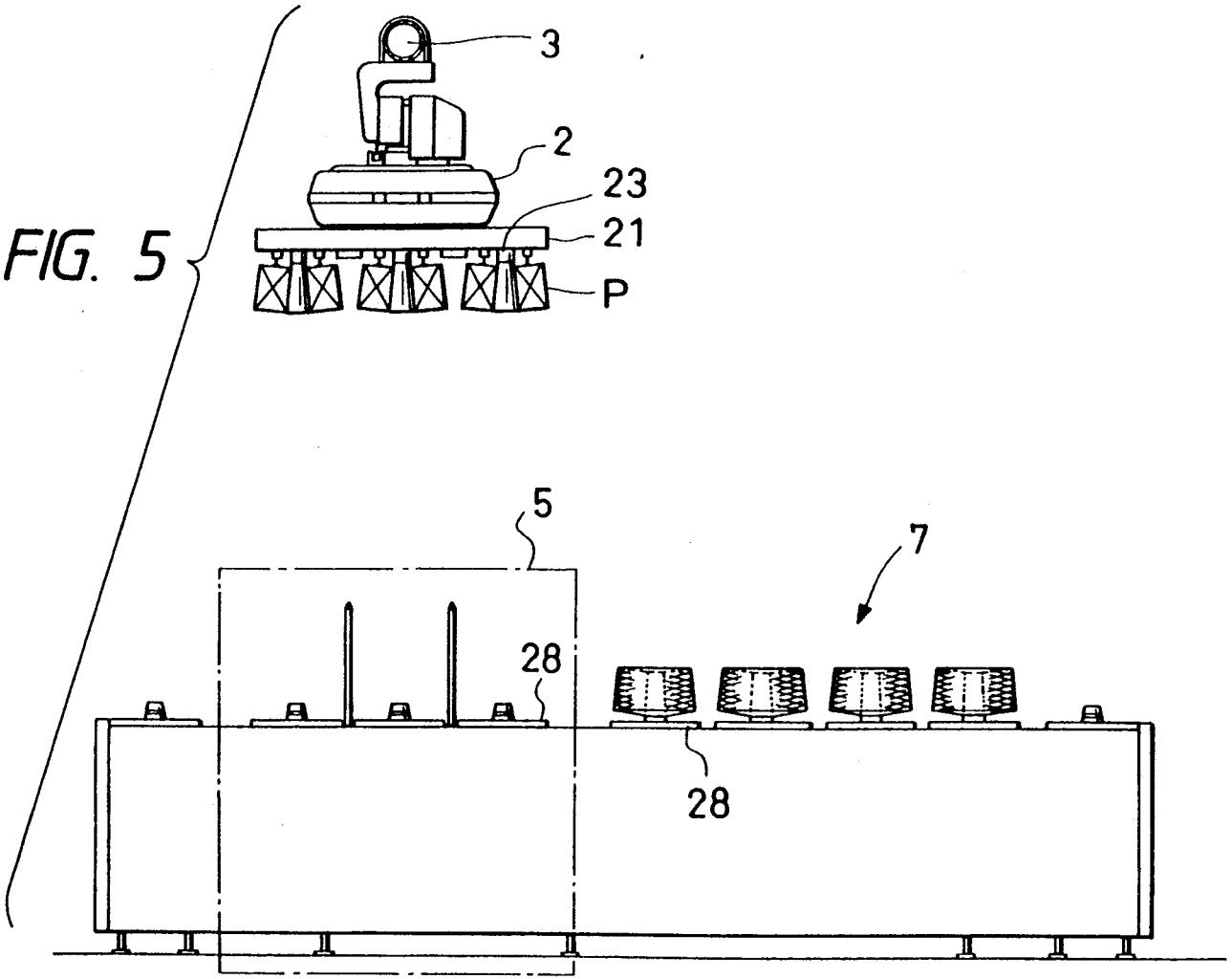
FIG. 5 is a side view of a package take-out device and a package supply station.

In FIG. 5, the package supply station 5 is provided as a part of a conveyor for transporting a tray 28. Packages P inserted, face up, on the tray 28 and arranged at a specific spacing can be hooked, up to three pieces at one time, by the chuck 23 of the overhead traveling truck 2.

Figure 6:
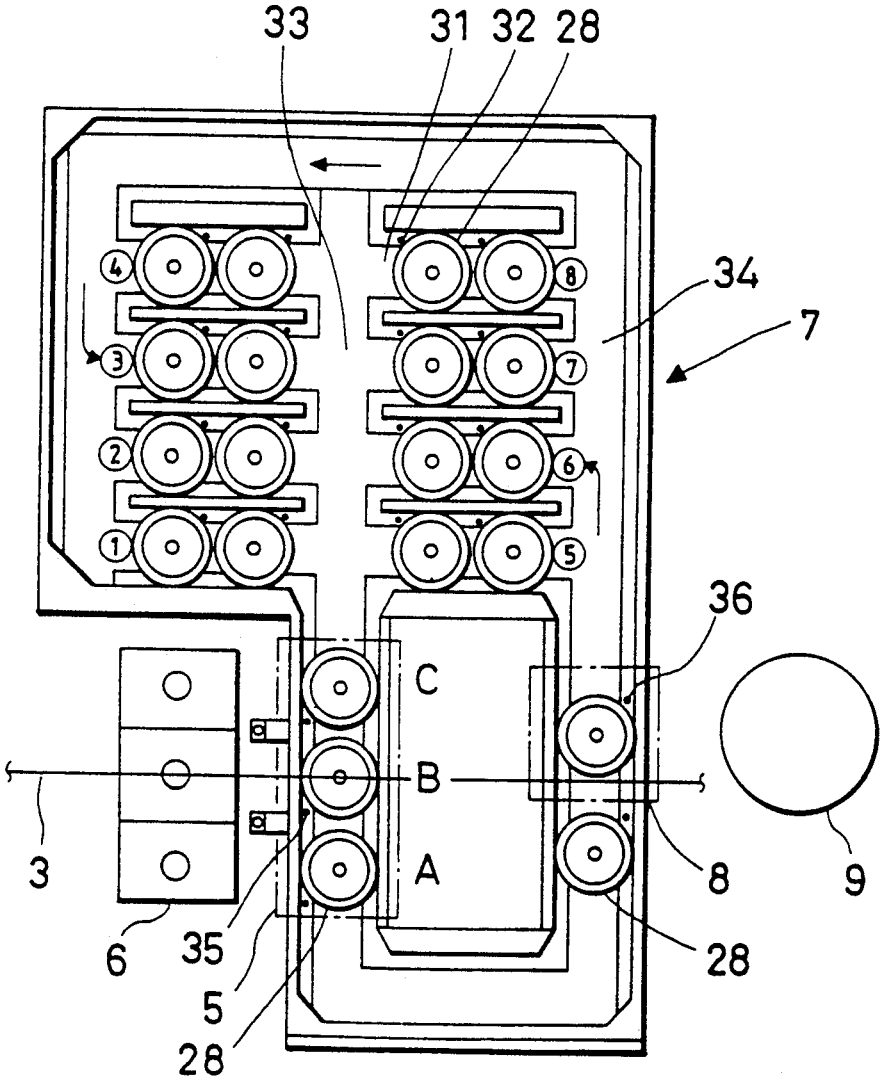
FIG. 6 is a top view of the package take-out device and the package supply station.

Furthermore, in FIG. 6, the package take-out device 7 has eight rows of storage conveyors 31, to each of which trays can be delivered one by one by means of a stopper 32. A delivering conveyor 33 is located at center of the four rows of storage conveyors 31 on both sides. This delivering conveyor 33 runs through the package supply station 5 and the transfer station 8 to a communication conveyor 34, which is connected to the entrance of the eight rows of storage conveyors 31. On these storage conveyors 31 are held trays 28 loaded with specific kinds (1) to (8) of packages. The trays will be delivered to the conveyor 33 in order as demanded, being brought as far as the A, B or C position in the package supply station 5. An empty tray 28 stops at the transfer station 8, where it will be loaded with a specific kind of package, which is same kind of the package delivered to the package supply station 5, from the transfer robot 9. The tray 28 thus newly loaded with the specific kind of the package will return to the storage conveyor 31 for the specific kind of package through the communication conveyor 34, being recirculated for carrying packages. Numerals 35 and 36 denote withdrawable stoppers for halting the tray 28 once at each station. When one tray is delivered from the storage conveyor 31, the tray stored at the inlet side of the storage conveyor 31 is moved to the outlet side thereof.

Subsequently, the mode of operation of the above-described weft supply system will be explained by referring to FIG. 1. For example, when the loom 1*a* demands weft of packages kinds (5), (4) and (3), a demand signal is inputted into the control device 11 through a communication line f1. The control device 11 then drives the package take-out device 7 through the communication line f2 in accordance with a prestored program. First, one tray is sent out from the storage conveyor 31 for kind (5) to the delivering conveyor 33. Then, this tray stops at the A position in the package supply station 5. Similarly, the tray of the kind (4) stops in the B position, and the tray of the kind (3) stops in the C position. Subsequently, the overhead traveling truck 2 stops immediately above the package supply station 5, and lowers the carrier 21 to catch the packages of kinds (5), (4) and (3). After the carrier 21 has been raised, the overhead traveling truck 2 travels until it stops immediately above the weft supply station 4*a*, lowering the carrier 21 and supplying the packages of kinds (5), (4) and (3). Then, the operator sets this package on the loom 1*a*, and inserts an empty take-up tube in the weft supply station 4*a* in that place. The overhead traveling truck 2 then carries the empty take-up tube to a point above an empty take-up tube recovery station 6, where the empty take-up tube will be dropped into a box.

The empty tray 28 remaining in the package supply station 5 after the conveyance of the specific kind of package by the overhead traveling truck 2 will be carried to the transfer station 8, and then the packages of kinds (5), (4) and (3) will be replenished in order from the warehouse 10 by means of the transfer robot 9. These trays will then go back to the storage conveyors for kinds (5), (4) and (3) through the communication conveyor 34.

Repeating the above-described operation can supply the specific types of packages to the loom. Also, it is possible to supply only one package of kind (8) with ease as in the case of the weft supply station 4*d* of the loom 1*d*. Since the kind and quantity of wefts can be selected as desired as described above, the weft supply system is suitable for use in the loom line for producing various many kinds of fabrics.

The weft supply system of the present invention is equipped with the package supply station connected to the package delivery device, by which packages of specific kinds of wefts can be taken-out to the package supply station. From this package supply station different kinds of packages are supplied by the overhead traveling truck to each of many looms requiring the packages. That is, it is possible to build a weft supply system suitable for looms producing many kinds of fabrics on a small scale.

What is claimed is:

1. In a weft supply system for a loom which is constructed to utilize a plurality of wefts of different types, each weft being in the form of a conical package, the system including an overhead traveling truck for carrying a weft between a package supply station and a weft supply station near the loom, the improvement comprising a package take-out device connected to said package supply station, said package take-out device comprising means for selecting one type of weft from the plurality of wefts of different types in response to a demand signal from the loom and for taking a package of the one type of weft from the package supply station.

2. A weft supply system as claimed in claim 1, further comprising a control device for receiving a demand signal from the loom and for driving said package take-out device in response to the demand signal from the loom to cause the package take-out device to take out a package corresponding to the one type of weft from the package supply station.

3. A weft supply system as claimed in claim 1, wherein said package take-out device includes a plurality of storage conveyors which store trays that are each loaded with a respective type of weft and that can deliver the trays one by one to the overhead traveling truck.

4. A weft supply system as claimed in claim 3, wherein said package take-out device comprises a plurality of storage conveyors, a delivering conveyor which is located between the storage conveyors and runs through the package supply station, and a communication conveyor which connects the delivering conveyor with an entrance of each of the storage conveyors.

5. A weft supply system as claimed in claim 4 wherein said package take-out device further comprises a transfer station and package loading means at said transfer station for loading a package of a selected type of weft onto an empty tray, and said communication conveyor is operative for moving a tray from said transfer station to a selected one of said storage conveyors.

6. A weft supply system as claimed in claim 1, wherein said overhead traveling truck is provided with a carrier which is suspended from said overhead traveling truck and is moved up and down by a hoist belt, and the carrier has a plurality of chucks for engaging with a take-up tube of a package.

7. A weft supply system as claimed in claim 6, wherein said chucks comprise a plurality of jaws which are adapted for opening and closing, a plurality of spring-loaded pads, and a triangular cam which makes reciprocative rotation by a cylinder provided within the carrier, said triangular cam being contacted with the side faces of the jaws.

* * * * *